US006527048B1

(12) United States Patent
Trosclair

(10) Patent No.: US 6,527,048 B1
(45) Date of Patent: Mar. 4, 2003

(54) HYDRAULICALLY ACTUATED DOWNHOLE COUPLER SYSTEM, ESPECIALLY FOR COMBINATION WASHOVER/FISHING TOOL ASSEMBLIES

(76) Inventor: David J. Trosclair, 602 Silver St., Houma, LA (US) 70364

( * ) Notice: Subject to any disclaimer, the term of this patent is extended or adjusted under 35 U.S.C. 154(b) by 0 days.

(21) Appl. No.: 09/781,463

(22) Filed: Feb. 12, 2001

(51) Int. Cl.[7] ..... E21B 17/02; E21B 17/07

(52) U.S. Cl. ..... 166/242.7; 166/242.6; 166/318; 175/321

(58) Field of Search ..... 166/242.6, 242.7, 166/242.1, 318, 99, 98, 373, 381, 382, 386, 301; 175/321

(56) References Cited

U.S. PATENT DOCUMENTS

| | | | | | |
|---|---|---|---|---|---|
| 2,762,438 | A | * | 9/1956 | Naylor | 166/215 |
| 2,947,362 | A | * | 8/1960 | Smith | 166/178 |
| 3,070,170 | A | * | 12/1962 | Bus, Sr. et al. | 166/237 |
| 3,581,834 | A | * | 6/1971 | Kellner et al. | 175/321 |
| 3,747,674 | A | | 7/1973 | Murray | |
| 3,785,690 | A | | 1/1974 | Hutchinson | |
| 4,281,726 | A | * | 8/1981 | Garrett | 175/321 |
| 4,877,085 | A | | 10/1989 | Pullig, Jr. | |
| 4,917,191 | A | * | 4/1990 | Hopmann et al. | 166/332.4 |
| 5,105,890 | A | * | 4/1992 | Duguid et al. | 166/380 |
| 5,348,086 | A | * | 9/1994 | Trout | 166/173 |
| 5,526,888 | A | * | 6/1996 | Gazewood | 166/242.6 |
| 5,673,754 | A | * | 10/1997 | Taylor, Jr. | 166/301 |
| 5,810,410 | A | | 9/1998 | Arterbury et al. | |
| 5,887,925 | A | * | 3/1999 | Arterbury et al. | 294/86.17 |

* cited by examiner

*Primary Examiner*—David Bagnell
*Assistant Examiner*—Jennifer H Gay
(74) *Attorney, Agent, or Firm*—Jesse D. Lambert

(57) ABSTRACT

A coupler system for downhole wellbore service tools comprises an elongated main body having a longitudinal bore, a plurality of release blocks disposed in slots in the main body wall, and an exterior spline about its circumference below the release blocks. The release blocks are movable radially inward and outward, and are biased inward by springs. A piston having a longitudinal bore is movably disposed within the main body bore. The piston has spaced apart larger diameter sections and a central smaller diameter section. A cylindrical washpipe body fits over the main body and has an internal spline for engagement with the main body spline, and shoulders (on the main body and on the interior of the washpipe body) limit downward movement of the washpipe body. In a first "set" position, the lower larger diameter section of the piston is adjacent the release blocks, forcing them outward against the spring bias so that the innermost ends of the release blocks are substantially flush with the inner wall of the main body bore, and the release blocks protrude from the main body outer wall and limit upward movement of the washpipe body. In a second "release" position, the central smaller diameter of the piston is adjacent the release blocks, which move inward under the spring bias so that the outmost ends of the release blocks are substantially flush with the outer wall of the main body. The washpipe body can then move upward.

16 Claims, 7 Drawing Sheets

HYDRAULICALLY ACTUATED DOWNHOLE COUPLER SYSTEM, ESPECIALLY FOR COMBINATION WASHOVER/FISHING TOOL ASSEMBLIES

BACKGROUND

1. Field of the Invention

This invention relates generally to apparatus used in connection with the drilling and servicing of earth boreholes. With more particularity, this invention relates to apparatus to be used in the manipulation of downhole equipment in earth boreholes commonly called "wells," whether open or cased boreholes. With still further particularity, this invention relates to a hydraulically actuated downhole coupler system which permits coupling and decoupling of downhole tool components, and is especially (although not exclusively) adapted for coupling, then decoupling at a desired time, a washover assembly to and from a workstring comprising a fishing tool such as a spear or overshot grapple.

2. Description of Related Art

Almost all oil and natural gas production is from earthen boreholes, commonly called "wells," which are drilled into a subterranean reservoir containing oil and/or natural gas. Wells are drilled with surface locations both onshore and offshore, and are today drilled in water depths of thousands of feet. The depths of the wells themselves may be many thousands of feet (quite commonly in excess of 10,000 feet, and as much as 20,000 feet) below the surface, whether ground or seafloor level. The geometry of such wells is appreciated when it is considered that a wellbore, for the sake of example having an inner diameter of 8–½", and a depth of 10,000 feet, has the relative proportions of a typical wooden pencil approximately 295 feet long.

It may further be readily appreciated that it is oftentimes difficult to manipulate equipment and tools downhole, via actions taken at the surface, many thousands of feet away. Where possible, manipulation of downhole tools via hydraulic means (by applying fluid pressure at the surface), rather than by purely mechanical means, is often desirable.

The term "fish" is commonly used in connection with wells (including wells being drilled and after being completed) to refer to downhole equipment which is either unintentionally left in the hole, for example as a result of an equipment failure or from becoming stuck downhole; or to refer to downhole equipment which was intentionally put into place at one time, but is now sought to be removed. A "fishing tool," then, refers to equipment employed to latch onto a fish to remove it from a well. Fishing tools are usually run into a well on the lower end of a string of drill pipe or tubing workstring, which is a string of threaded and coupled pipe of sufficient length to reach the downhole objective depth. For purposes of this patent application, the term "drillstring" will be used to refer to either drill pipe or tubing. Some fishing tools are spears, which enter an inner bore of a fish (for example, the bore of a piece of pipe); others are grapples or "overshots," which have a bore large enough for the fish to enter the overshot bore, or said another way, the overshot engulfs the fish to connect or latch onto it.

Another condition which must often be addressed in retrieval of a fish is removal of material which has settled into a gap or annulus between the fish and the wall of the casing or open borehole. Such material may be formation solids such as sand and clay; or may be materials introduced into the wellbore, such as cement; or may be small pieces of fish such as steel cuttings which have settled in about the larger fish. The effect of such material when packed in around a fish is to firmly lodge the fish in place, and to retrieve the fish the material must be removed from the fish/wellbore annulus. Removal may be by a process called "washing over," which uses "washpipe" having a cutting or milling bottom edge (commonly called a "rotary shoe"), the washpipe having inner and outer diameters which permit it to pass through the annulus between the fish and the wellbore. By rotation of the washpipe and the rotary shoe and pumping of fluids (whether drilling mud or completion fluids), the material lodging the fish in place can then be removed. The remaining task is to latch onto the fish with a spear or overshot and pull the fish from the well.

An exemplary situation in which washover and then fishing operations are required is the retrieval of downhole sand control assemblies, commonly called a "gravel pack," from a well. Certain producing formations have a tendency to flow not only formation fluids (oil and gas) but also sand from the formation, which is undesirable and potentially dangerous. A typical gravel pack assembly comprises a first or bottom packer (which is usually a permanent packer, not readily retrieved) which is set in the wellbore below the formation to be produced; a screen and blank pipe assembly which is stabbed into the first packer (referred to as a "screen assembly"); and a second or top packer (which is usually a retrievable packer that can be later released and pulled from the well) at the top of the screen assembly. A piece of the blank pipe between the screen and the top packer forms a "safety sub" or "safety joint" and is configured so that it may be relatively easily separated by pulling it apart. Once the screen assembly is in place, a slurry of a carrying fluid and a relatively coarse sand or "gravel" is placed into the annulus between the outside of the screen and the inner wall of the casing and into the perforations. The gravel acts as a filter, permitting fluid flow from the formation but preventing sand production.

For various reasons, it may be desirable to work over or recomplete a gravel packed well and to do so retrieval of the gravel pack assembly (that is, the top packer and blank pipe and screen assembly) is required. Two required actions to permit retrieving the total assembly are (1) removal of the top packer, and (2) washing away the gravel in the screen/casing annulus which tends to be very firmly packed and therefore "locks" the screen assembly in place, and thereafter latching onto and retrieving the blank pipe and screen assembly.

With conventional "separate" fishing tools, to retrieve the top packer, wash over the screen assembly, then pull the screen assembly from the hole, typically three downhole tool runs are required:

1. Run #1 with a packer retrieving tool. This tool locks into the top packer, and pulling on the tool releases the packer from its grip on the casing wall. Continued pulling then separates the safety sub, and the top packer with a short piece of the blank pipe attached is then pulled from the well.
2. Run #2 with a washpipe assembly, to wash over the screen assembly and remove the gravel in the screen/casing annulus.
3. Run #3 with an overshot or spear to engage the uppermost section of the blank pipe/screen assembly and pull it from the well.

Considerable benefit arises out of combining steps 2 and 3 above. With deeper wells, the trip in and out of the well consumes a number of hours, and with overall daily costs at times exceeding $100,000 per day, a single trip might represent $100,000 in costs. In short, the ability to accomplish both the washover and fishing operation by a single trip in the well, with a combination washpipe and fishing tool assembly, is of great value. A combination washpipe and fishing tool assembly has the fishing tool (such as a spear or overshot) connected to the lower end of the drillstring, with the washpipe both longitudinally and rotationally fixed to the drillstring via a coupler system such that the fishing tool is disposed within the upper portion of the washpipe. At a selected time, the coupler system permits disconnecting the washpipe from a fixed position with respect to the drillstring, and permits the washpipe to ride up about the drillstring, with the fishing tool moving (in relative terms) downwardly within the washpipe to latch onto the fish.

The related art shows several tools which combine a washover and fishing assembly, coupled together via mechanical means so that first the washover assembly can be employed, then the fishing assembly employed to latch onto and then retrieve the fish. Different mechanical means for connecting and then selectively disconnecting the washover and fishing tool assemblies disclosed in the related art include simple set screws which are sheared to disconnect, such as in U.S. Pat. No. 5,810,410 to Arterbury et al, Sep. 22, 1998 and U.S. Pat. No. 5,887,925 to Arterbury et al, Mar. 30, 1999; and a J-latch assembly, such as in U.S. Pat. No. 3,785,690 to Hutchinson, Jan. 15, 1974. Other examples of washover/fishing tool apparatus are U.S. Pat. No. 3,747,674 to Murray, Jul. 24, 1973; and U.S. Pat. No. 4,877,085 to Pullig, Jr., Oct. 31, 1989.

The known related art does not disclose a downhole tool comprising a hydraulically actuated coupler system which initially couples a washover assembly to a drillstring/fishing tool assembly, then at a desired time, via hydraulic operation, uncouples the two assemblies so that the washover assembly may move upwardly about the drillstring and the fishing tool lowered and employed to engage the fish.

DESCRIPTION OF ONE PRESENTLY PREFERRED EMBODIMENT AND ITS OPERATION

While many different embodiments of the present invention are possible, with reference to the drawings one presently preferred embodiment will be described. First, the structure of the coupler system will be described, then by way of example only its incorporation into a combination washover/fishing tool assembly and use in retrieval of a typical gravel pack assembly will be described. It is understood, however, that applications of the coupler system are not confined to coupling of washover/fishing tool assemblies for retrieval of gravel pack assemblies, but include any situation where retrieval of a downhole fish is contemplated, via first a washover then a latching operation; and further encompass much broader application to downhole well servicing tools whereby coupling then selective uncoupling of downhole tools is required.

A. The Structure of the Present Invention

1. First or "set" position

Figure 2:
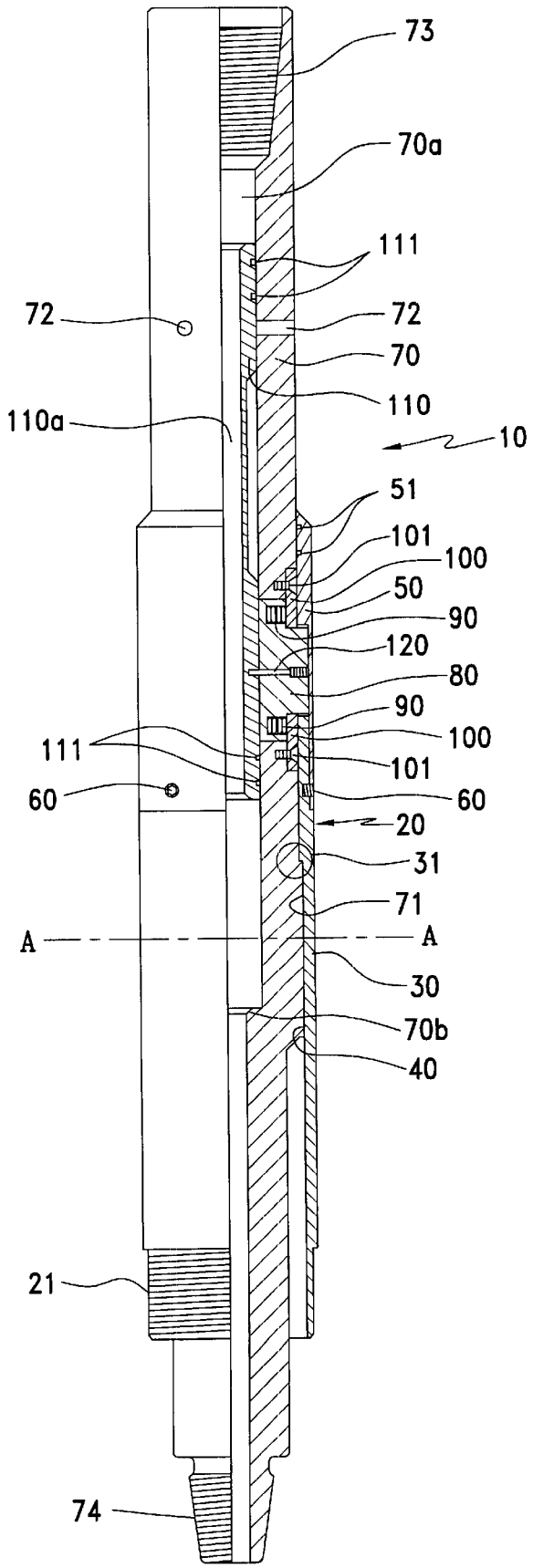
FIG. 2 is a detailed view in partial cross section of the coupler of the present invention, in a first or "set" position.

Referring to FIG. 2, the coupler 10 is shown in a first or set position. Coupler 10 comprises a main body 70 preferably comprising an upper threaded connection 73 (typically box) for connection to a drill string, and a lower threaded connection 74 (typically pin) for connection to a spear or an overshot (which, as described below, latches onto the remaining portion of the safety sub for pulling the blank pipe and screen assembly out of the hole). Depending upon the particular fishing tool arrangement, a jet sub or circulating sub (not shown) may be provided between main body 70 and the spear or overshot, to ensure circulation if the spear or overshot becomes plugged. Main body 70 has a set of drain holes 72 to permit fluid communication between the drill string and the drill string/casing annulus after the tool has been shifted, as is later explained. Drain holes 72 prevent the drill string from being pulled "wet." Main body 70 also has a bore 70*a* therethrough, in the preferred embodiment having a smaller diameter at the lower portion of main body 70 and a larger diameter at the upper portion of main body 70, and a contour comprising a shoulder 70*b* at the bore diameter transition. It is understood that in alternative embodiments bore 70*a* may be of a uniform size throughout the length of the tool, with shoulder 70*b* comprising a "step" or ledge serving to provide a positive stop for movement of piston 110.

Figure 3:
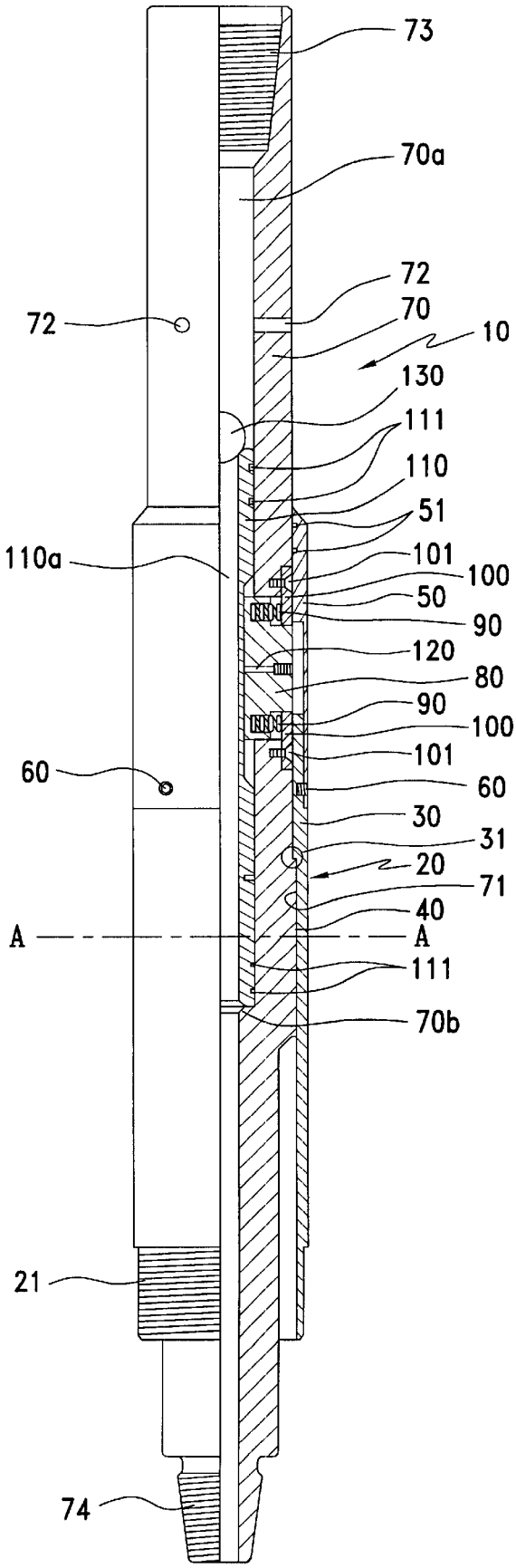
FIG. 3 is a detailed view in partial cross section of the coupler system, in a second or "release" position.

Main body 70 has an exterior spline 71 which mates with an interior spline 40 in washpipe body 30, as will be described further below. Release blocks 80 (which, depending upon the size of the coupler, by way of example only may be from 2 to 6 in number) are mounted in slots in main body 70 (said slots fully penetrating the wall of main body 70), are movable radially inwardly and outwardly, and are retained in place by springs 90 which are in turn held in place by retainer blocks 100. Retainer blocks 100 mount to main body 70 by screws 101. When retainer blocks 100 are in place, springs 90 are in compression and tend to push release blocks 80 radially inward toward bore 70*a*. Release blocks 80 are dimensioned such that when a radially innermost surface of release blocks 80 is substantially flush with the inner wall of bore 70*a*, release blocks 80 protrude beyond the outer surface of main body 70, as can be seen in FIG. 2; likewise, when release blocks 80 are in a radially inward position (when the tool is in the "release" position, as described below) then the radially outermost surface of release blocks 80 are substantially flush with the outer surface of main body 70 (as can be seen in FIG. 3).

Piston 110 is disposed within the upper bore section of main body 70. Piston 110 has a bore 110*a*, spaced-apart upper and lower sections with outer diameters near the diameter of upper bore section of main body 70, and a middle section with a reduced outer diameter. O-rings 111 on the upper and lower larger diameter sections provide a resilient seal between piston 110 and bore 70*a* and permit shifting of the piston via hydraulic pressure as later described. As is shown in FIG. 2, in the set position piston 110 is positioned whereby its lower larger diameter section is adjacent release blocks 80, forcing release blocks 80 (described in more detail below) radially outward and compressing springs 90. In this position, release blocks 80 protrude from the outer surface of main body 70, and while in the preferred embodiment a small clearance exists between release blocks 80 and the uppermost surface of washpipe body 30, release blocks 80 effectively prevent any significant longitudinal movement of washpipe body 30 (and hence washpipe assembly 20) upward.

Washpipe assembly 20 comprises debris retainer 50 coupled to washpipe body 30, typically via screws 60. Washpipe body 30 has an inner diameter which permits it to slide over main body 70 to the position shown in FIG. 2, with spline 40 of washpipe body 30 having an inner shoulder abutting a shoulder on spline 71 of main body 70, the two shoulders denoted as 31, preventing any further movement of washpipe body 30 downward with respect to main body 70. In that position, as stated above, release blocks 80 protrude outwardly and prevent any significant movement of washpipe body 30 upward with respect to main body 70. Therefore, in the "set position," washpipe body 30, and therefore washpipe assembly 20 is longitudinally fixed with relation to main body 70 (and hence with relation to the drill string). Washpipe body 30 preferably has threads 21 at a lower end. O-rings 51 are disposed between debris retainer 50 and main body 70 to provide a seal therebetween.

Figure 4:
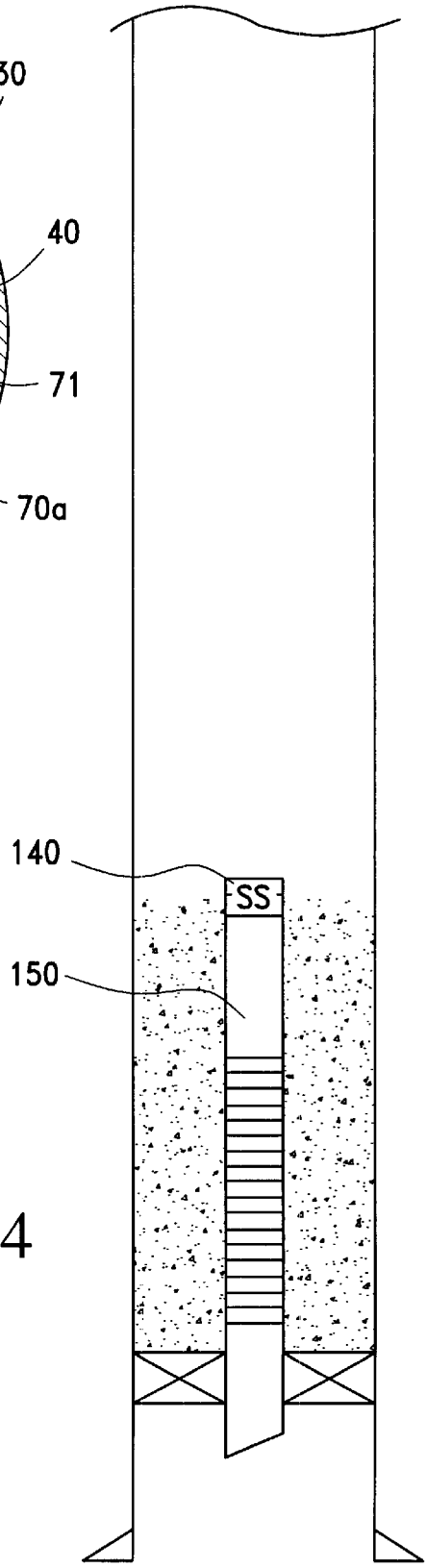
FIG. 4 is a view of the remainder of the gravel pack screen assembly after the top packer has been retrieved. The bottom half of the safety sub is the uppermost piece of the remaining assembly.

The preferred embodiment of the invention has from 2 to 6 release blocks 80 equally spaced about the circumference of main body 70, depending upon the size of the tool. As shown in FIGS. 3 and 4, release blocks 80 are held in slots in main body 70. Retainer blocks 100 are attached to main body 70, preferably by screws 101. Springs 90 are held in place by retainer blocks 100, and springs 90 bear against retainer blocks 80 and bias retainer blocks 80 radially inward.

Figure 3A:
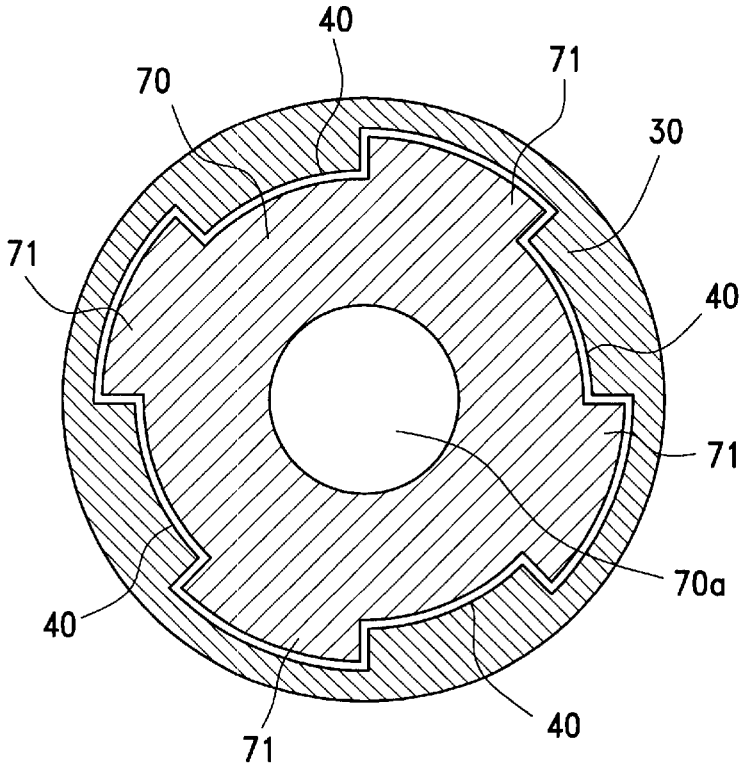
FIG. 3*a* is a cross section of the mating spline section along section A—A as shown in FIGS. 2 and 3.

In addition to being longitudinally fixed to one another as described above, washpipe assembly 20 and main body 70 are rotationally locked together via a spline 71 on the exterior of main body 70 engaging a spline 40 in the interior of washpipe body 30. FIG. 3*a* is a section along line A—A shown in FIGS. 2 and 3, showing splines 71 and 40. In the preferred embodiment, the splines have from 4 to 8 keys, depending upon the size of the tool, but a greater or lesser number could be employed. As described above, the spline sections have shoulders denoted by 31 which also limit movement of washpipe body 30 downward on main body 70. It is understood that the scope of the invention contemplates any variety of mating cross-sectional shapes which rotationally lock washpipe body 30 to main body 70, by way of example mating shapes such as hexagonal or octagonal shapes.

Shear pins 120, mounted in release blocks 80, keep piston 110 fixed within the bore of main body 70 (of course, until shear pins 120 are sheared), when the tool is in the set position. In that position, drain holes 72 are blocked by the upper larger diameter section of piston 110. In FIG. 2, shear pins 120 are shown protruding into the body of piston 110. FIG. 3 shows the coupler after shifting of piston 110 downward, shearing shear pins 120 in the process.

Typically, the various parts of coupler 10 are made of high strength steel alloys, and are formed by machining parts to appropriate shapes and dimensions from solid stock. Certain parts, for example the shear pins, may be made of materials such as brass. However, it is understood that other materials and methods of manufacture of component parts could be used. The dimensions of coupler 10, washpipe body 20 and other component parts of the invention may be any dimension adapted to use within a wellbore.

2. Second or "Release" Position

FIG. 3 shows coupler 10 in the second or release position. To release the coupler, a plug such as ball 130 is dropped down through the bore of the drill string where it lands atop piston 110, closing off the bore 110*a* of the piston and forming a seal. It is understood and contemplated within the scope of this invention that a variety of different plug shapes could be used, such as a ball or sphere as illustrated; or an elongated plug, with or without seal elements thereon, as long as said plug may readily drop down a fluid column or be pumped down, and seal atop the bore 110*a* of piston 110. Once ball 130 is in position atop piston 110, fluid pressure is then applied (via pumping from the surface into the drill string bore) to the bore of the drill string, and the force thus created on piston 110 shears shear pins 120, then pushes piston 110 downward to a second position as shown in FIG. 3. In that position, the central smaller diameter section of piston 110 is opposite release blocks 80. Release blocks 80 under the force of springs 90 move radially inward, to a position in which the radially outermost part of release blocks 80 are substantially flush with the outer surface of main body 70. Release blocks 80 thereby disengage from washpipe body 30 and hence washpipe assembly 20, and washpipe assembly 20 is thereby free to move axially upward (from the position shown in FIG. 3) with respect to main body 70.

Figure 1:
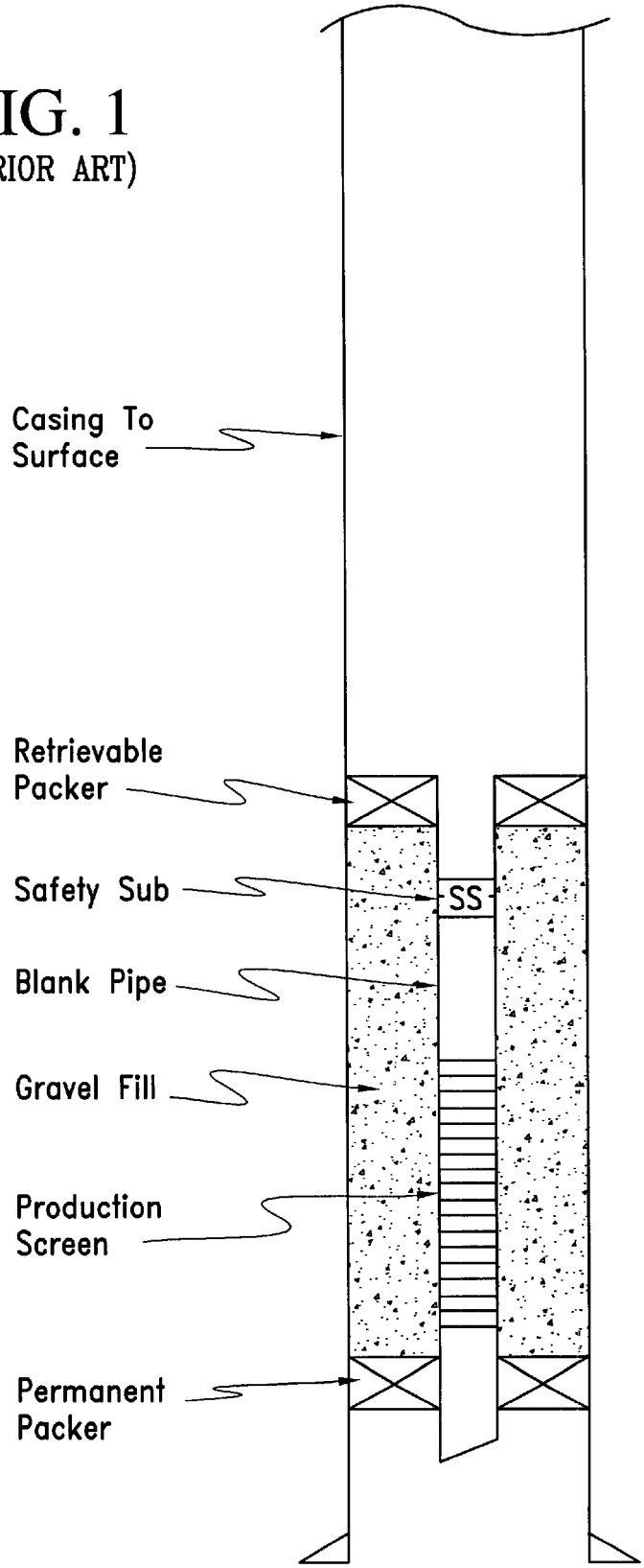
FIG. 1 (PRIOR ART)
FIG. 1 is a cross section view of a typical gravel pack assembly, showing in particular the casing string, top and bottom packers, gravel pack screen and blank pipe assembly, and gravel fill. This figure shows the downhole equipment arrangement after the production tubing string has been pulled out of the top packer and removed from the well.

B. Operation of the Coupler System in Conjunction with a Washover/fishing Assembly Operation of the present invention is illustrated particularly in FIGS. 1 and 4 through 10. FIG. 1 is a schematic in partial cross section of a typical gravel pack assembly, showing in particular the casing string, top (retrievable) and bottom (permanent) packers, gravel pack (production) screen and blank pipe assembly (including shearable safety sub), and gravel fill.

FIG. 4 shows the blank pipe and screen assembly 150 after the top packer is removed, leaving the lower portion of the safety sub 140 as the uppermost part. It is removal of this entire assembly (save for the bottom permanent packer, which is typically left in place and poses no obstacle) in a single trip which is a key efficiency of the present invention.

Figure 5:
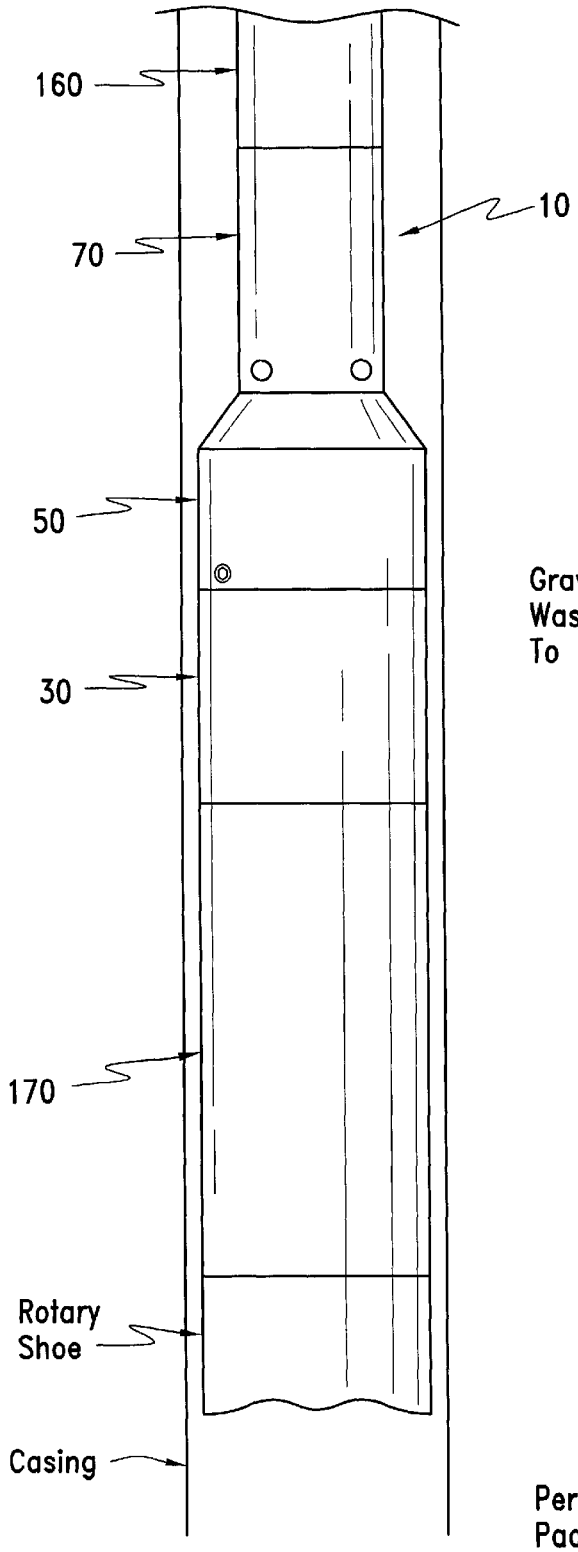
FIG. 5 is a view of the tool connected to a drill string and with washpipe mounted thereon.
Figure 6:
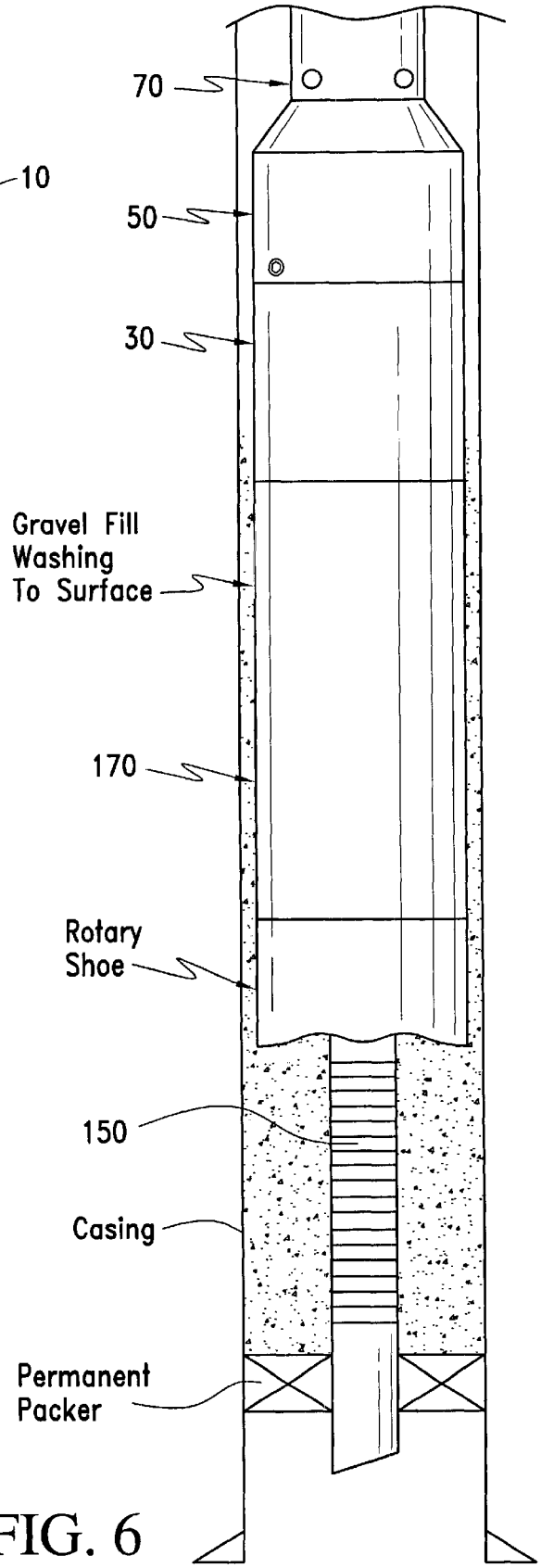
FIG. 6 is a view of the tool run into a wellbore and showing progress washing over the screen assembly.
Figure 7:
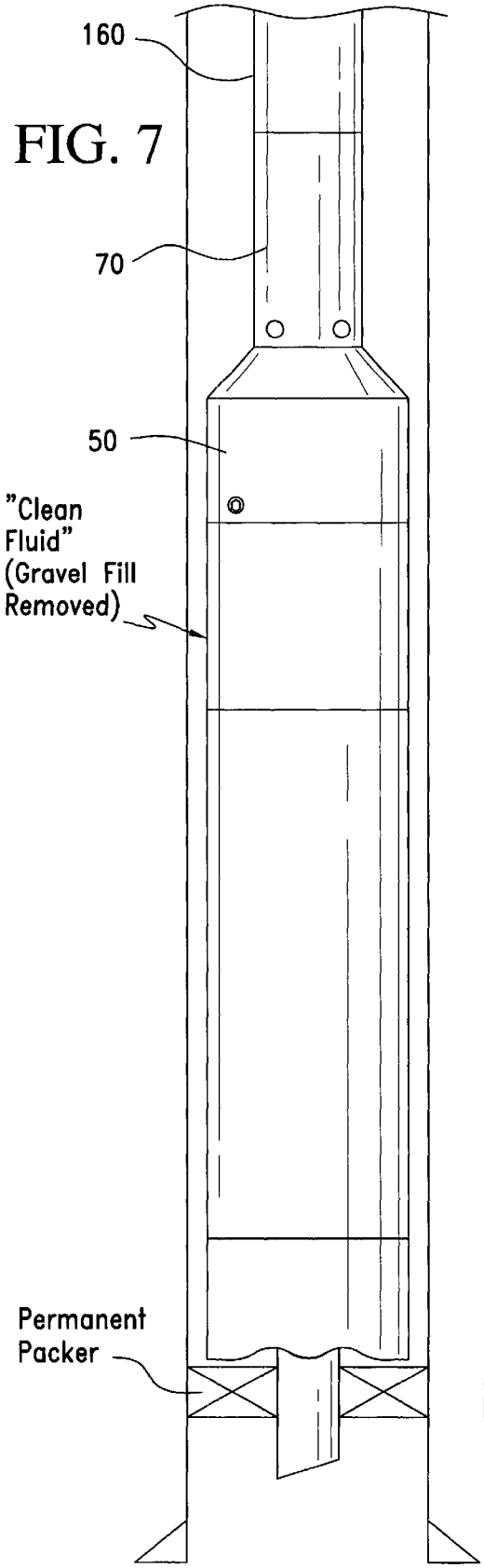
FIG. 7 is a view of the tool at the completion of the washover procedure.

FIG. 5 shows coupler 10 (including main body 70, debris retainer 50, and washpipe body 30) made up to a drill string 160 and with a section of washpipe 170 connected to the bottom of the washpipe body 30. A rotary shoe or "burning shoe" is attached to the lower end of washpipe 170. A rotary shoe is typically a toothed or serrated, carbide coated piece adapted to drill and/or grind away downhole equipment or formations. FIG. 6 shows the progression of the washover operation, where the screen assembly is being washed over. During this operation, wash pipe 170 is rotating in the annulus between the blank pipe and screen assembly 150 and the casing, washing away the gravel fill in that annulus. FIG. 7 shows the position of the downhole assembly at the end of the washover procedure (when the rotary shoe reaches the bottom permanent packer).

Figure 8:
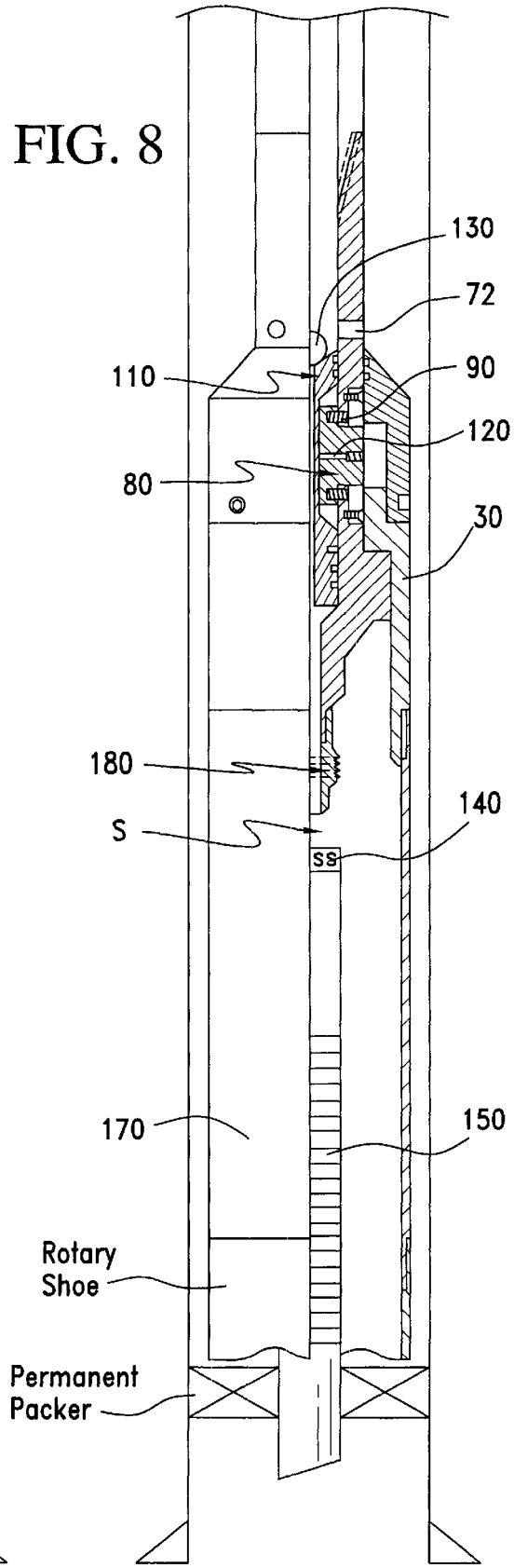
FIG. 8 is a cross-sectional view of the tool in the release position, but prior to lowering of the main body of the tool and engaging the spear in the safety sub.

In FIG. 8 (certain element numbers have been omitted for clarity), drill string 160 is raised slightly so as to lift the washpipe assembly and rotary shoe off of the permanent packer and/or gravel fill (that is, sufficiently to ensure that the washpipe assembly is "hanging" from the shoulders 31, therefore ensuring that release blocks 80 are not constrained from movement by compression forces from the washpipe assembly being pushed upwardly), and ball 130 has been dropped to its place atop piston 110, and hydraulic pressure has been applied to the bore of the drill string to shear pin 120 and shift piston 110 downward to a position in which the smaller diameter section of piston 110 is adjacent release blocks 80. Release blocks 80 are then moved radially inward by springs 90, to a position substantially flush with an outer surface of main body 70. In that position, as shown in FIG. 8, washpipe body 30 is no longer blocked from movement relatively upward with respect to main body 70. It should be noted that in the position shown in FIG. 8 (the shifted or release position) drain holes 72 in main body 70 are opened (being no longer covered by piston 110), therefore fluid communication and circulation between the bore of drill string 160 and the drill string/casing annulus is possible. FIG. 8 further shows a fishing tool, in this case a spear 180 being illustrated, for engaging the remaining end of safety sub 140 (to permit extracting it from the hole). A jet sub or circulating sub (not shown) may be installed above spear 180 to ensure circulation capabilities.

It should be noted that in a typical gravel pack assembly fishing operation, approximately 120' to 160' of washpipe 170 is run, as in FIG. 6, to enable washing over the entirety of the gravel pack fill distance (obviously the particular length of the gravel packed interval will dictate washpipe length). Referring to FIG. 8, when the gravel pack section has been completely washed over, typically 15' to 20' of space (denoted by element S) is between the top of safety sub 140 and the bottom of spear 180 (it being understood that an overshot grapple rather than a spear may be used). It should be understood that the above-mentioned spacing dimensions are by way of example only.

Figure 9:
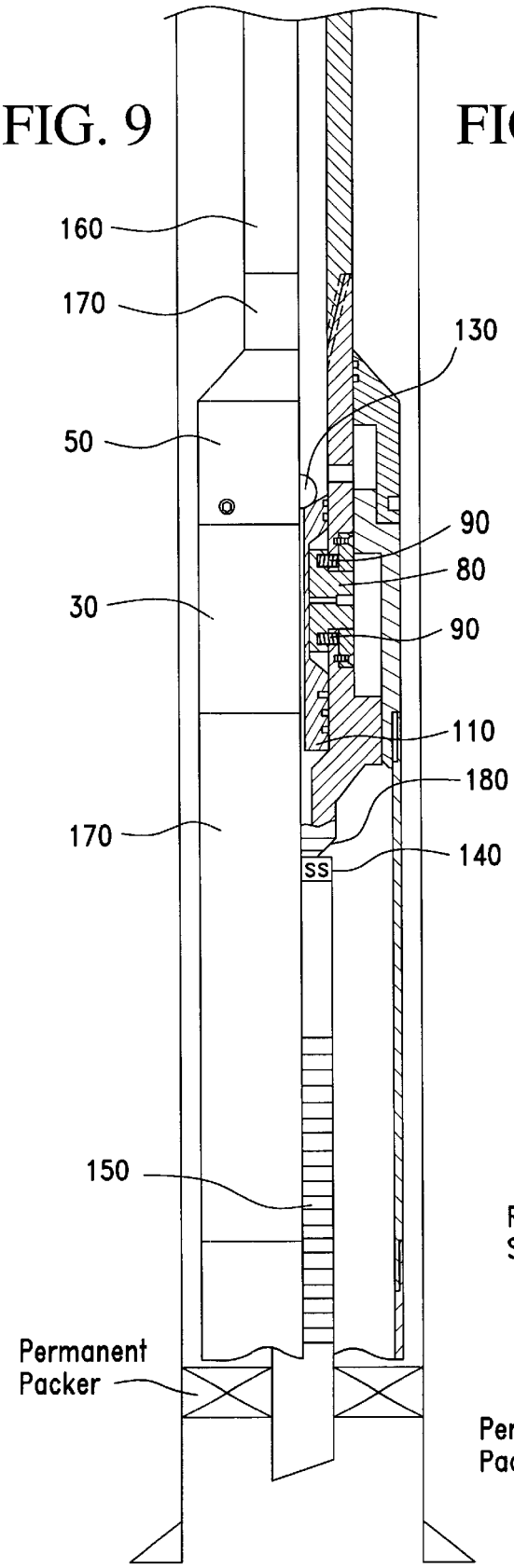
FIG. 9 shows the main body of the tool lowered on the drill string (with the wash pipe assembly riding up around the main body of the tool and the drill string) and the spear engaged in the safety sub.

FIG. 9 shows main body 70, carrying the spear, lowered on drill string 160 so as to engage safety sub 140. As the entire assembly is lowered, the washpipe assembly cannot move downward any farther once it contacts the permanent packer, therefore as shown in FIG. 9 washpipe assembly 20 rides up around the drill string.

Figure 10:
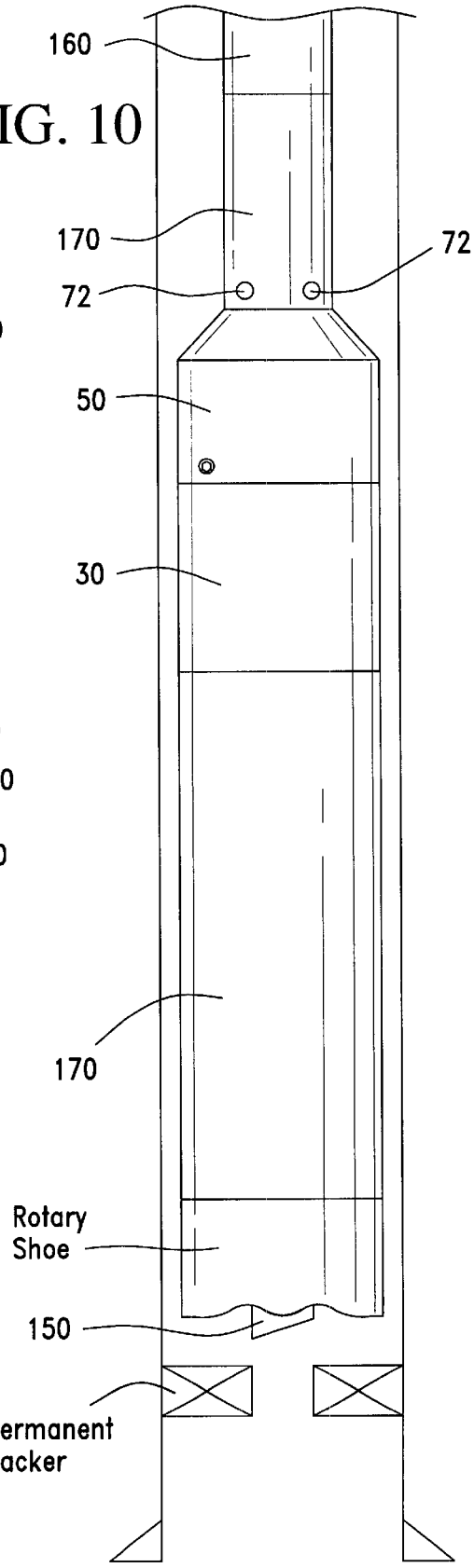
FIG. 10 is a view of the tool with the entire assembly (drill string, tool, and "fish") being pulled up out of the well.

Thereafter, drill string 160 is raised until the splines 71 and 40 again engage and (preferably) until shoulders 31 meet, and continued raising of the assembly as shown in FIG. 10 shows the entire assembly of the present invention, with the basepipe and screen assembly impaled on the spear, being pulled out of the wellbore. With the washpipe assembly 20 once again lowered with respect to main body 70, drain holes 72 are again exposed, and fluid communication between the drill string bore and the drill string/casing annulus is established. The lowermost end of blank pipe and screen assembly 150 can be seen protruding from the washpipe/rotary shoe assembly. It can thus be seen that the washing over of the blank pipe and screen assembly and retrieval thereof may be accomplished in a single trip.

Although the description above contains many specificities, these should not be construed as limiting the scope of the invention but as merely providing illustrations of some of the presently preferred embodiments of this invention. For example, different materials may be used to manufacture the present invention, including steel, aluminum, and other different metal alloys; the number and shapes of different elements may differ, such as the number of release blocks, the shapes of the actuating piston and the like; and the tool may be employed for washover and then retrieval of any downhole fish in a well (in addition to the disclosed use of retrieval of a gravel pack screen assembly), such as packers (permanent and retrievable), other downhole tools, etc. Furthermore, the tool may be employed in both open hole settings, where no casing has yet been run in the well; and cased hole situations. Further still, it is envisioned and within the scope of this invention to employ the present invention in connection with wellbore operations outside of fishing operations, by way of example only tools used in setting of casing liner hangers and the like.

Thus, the scope of the invention should be determined by the appended claims and their legal equivalents, rather than by the examples given.

I claim:

1. A coupler system for downhole wellbore tools, comprising:

a) a main body having a longitudinal bore, an upper end adapted for connection to a tubular drillstring, and a lower end;

b) a plurality of release blocks disposed in slots in said main body and movable radially inward and outward, and a plurality of springs biasing said release blocks radially inward;

c) a piston disposed in said longitudinal bore of said main body, said piston having a longitudinal bore and spaced apart upper and lower larger outer diameter sections on either side of a central smaller outer diameter section, said piston longitudinally movable between first and second positions, in said first position said lower larger outer diameter section being adjacent said release blocks and forcing them radially outward, in said second position said central smaller outer diameter section being adjacent said release blocks, in said second position said release blocks being moved by said springs to a radially inward position, an upper end of said piston adapted to sealingly receive a plug; and d) means for releasably retaining said piston in said first position.

2. The system of claim 1, further comprising a plug sealing said bore of said piston.

3. The system of claim 2, wherein said plug is a ball.

4. The system of claim 2, wherein said means for releasably retaining said piston in said first position comprises one or more shear pins extending from one or more of said release blocks into said piston.

5. The system of claim 4, further comprising a contour in said bore of said main body for limiting downward movement of said piston.

6. The system of claim 5, further comprising drain holes in said main body which permit fluid communication between said drillstring bore and an annulus between said drillstring and a casing string.

7. The system of claim 6, wherein said main body has an exterior circumferential spline section thereon, and further comprising a tubular washpipe body disposed over said main body, said washpipe body having an interior spline adapted to mate with said spline on said main body, said splines comprising a pair of mating shoulders limiting downward movement of said washpipe body with respect to said main body, and wherein upward movement of said washpipe body with respect to said main body is limited by said release blocks when said piston is in said first position and said release blocks are in a radially outward position.

8. The system of claim 7 wherein said plurality of release blocks comprises 2 to 6 release blocks.

9. The system of claim 8 wherein said splines comprise from 4–8 spline ribs.

10. The system of claim 7, further comprising a cylindrical debris retainer positioned over said main body and attached to said washpipe body, said debris retainer covering said release blocks.

11. A coupler system for downhole wellbore tools, comprising:

a) a main body having a longitudinal bore, an upper end adapted for connection to a tubular drillstring, a lower end, and an exterior circumferential spline;

b) a plurality of release blocks disposed in slots in said main body and movable radially inward and outward, and a plurality of springs biasing said release blocks radially inward;

c) a piston disposed in said longitudinal bore, said piston having a longitudinal bore and spaced apart upper and lower larger outer diameter sections on either side of a central smaller outer diameter section, said piston longitudinally movable between first and second positions, a contour in said bore of said main body limiting downward movement of said piston, in said first position said lower larger outer diameter section being adjacent said release blocks and forcing them radially outward, in said second position said central smaller outer diameter section being adjacent said release blocks, in said second position said release blocks being moved by said springs to a radially inward position, an upper end of said piston adapted to sealingly receive a plug, said main body further comprising one or more drain holes fluidly connecting a bore of said drill string to an annulus between said drill string and a casing string when said piston is in said second position;

d) one or more shear pins extending from one or more of said release blocks into said piston when said piston is in said first position; and e) a tubular washpipe body disposed over said main body, said washpipe body having an interior spline adapted to mate with said spline on said main body, said splines comprising a pair of mating shoulders limiting downward movement of said washpipe body with respect to said main body, and wherein upward movement of said washpipe body with respect to said main body is limited by said release blocks when said piston is in said first position and said release blocks are in a radially outward position.

12. The system of claim 11, further comprising a plug sealing said bore of said piston.

13. The system of claim 11, further comprising a length of washpipe attached to said washpipe body.

14. The system of claim 13, further comprising a rotary shoe attached to a lower end of said washpipe.

15. The system of claim 14, further comprising a spear attached to said lower end of said main body.

16. The system of claim 14, further comprising an overshot grapple attached to said lower end of said main body.

* * * * *